US005275417A

United States Patent [19]

Seymour

[11] Patent Number: 5,275,417

[45] Date of Patent: Jan. 4, 1994

[54] TETHERED FLYING CIRCULAR SPINNING TOY

[76] Inventor: William D. Seymour, 544 Saxony Dr., Delray Beach, Fla. 33446

[21] Appl. No.: 899,381

[22] Filed: Jun. 16, 1992

[51] Int. Cl.[5] ..... A63B 71/00

[52] U.S. Cl. ..... 273/330; 273/425; 446/46

[58] Field of Search ..... 273/329, 330, 332, 413, 273/414, 424, 425; 446/46, 48, 452

[56] References Cited

U.S. PATENT DOCUMENTS

| | | | |
|---|---|---|---|
| 3,358,399 | 12/1967 | Waldmann | 43/4 |
| 3,590,518 | 7/1971 | LeBaron | 273/425 |
| 3,673,732 | 7/1972 | Liotta | 446/46 |
| 3,828,466 | 8/1974 | Geiger | 273/425 X |
| 3,976,297 | 8/1976 | Seymour | 446/46 X |
| 4,058,314 | 11/1977 | Wolf | 273/424 |
| 4,209,936 | 7/1980 | Sklar | 446/46 |
| 4,802,875 | 2/1989 | Cunningham | 446/46 |
| 4,878,868 | 11/1989 | Shaw | 273/414 |
| 4,955,842 | 9/1990 | Marcotti | 446/46 |
| 5,123,869 | 6/1992 | Schipmann | 446/46 |

FOREIGN PATENT DOCUMENTS

| | | | |
|---|---|---|---|
| 467331 | 12/1951 | Italy | 446/48 |

*Primary Examiner*—William Stoll

*Attorney, Agent, or Firm*—Alvin S. Blum

[57] ABSTRACT

A flying spinning tether toy has an annular rim and a transverse bar across the diameter joined to the rim. The transverse bar has an axial tubulation with a center hole at the axis of rotation. A closed loop of line passes through the center hole and around the rim at one point. A tether line connects to the loop. The toy is thrown with a spin like a discus. When flown to the full extent of the tether line, a pull on the line changes the direction of flight and the toy will return to the player. To keep the toy flying and spinning, the transverse bar is provided with a propeller like shape with sloping surfaces to provide lift, and the leading and trailing edges of the transverse bar are provided with low and high resistance faces to enhance spinning when pulled. Embodiments are shown having either the lifting elements or the unidirectional resistance elements alone. The spinning toy may also be provided in the shape of an inverted saucer.

15 Claims, 1 Drawing Sheet

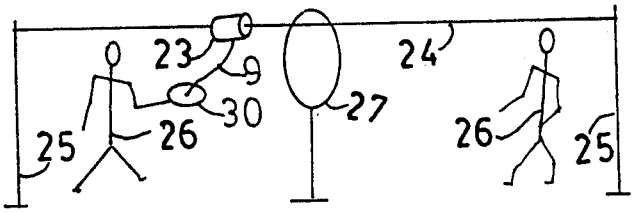
FIG. 9
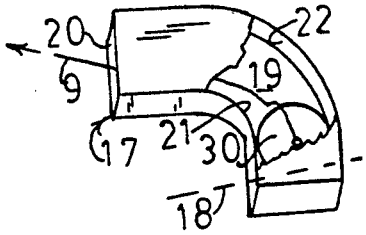
FIG. 8
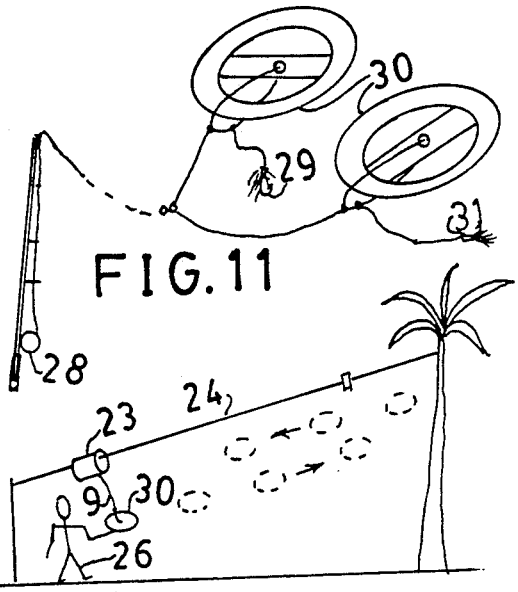
FIG. 11
FIG. 10
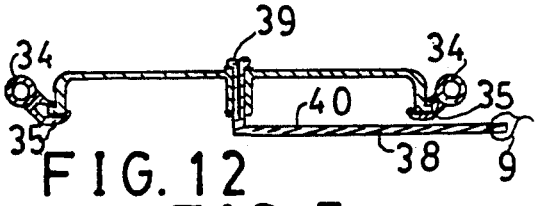
FIG. 12
FIG. 7
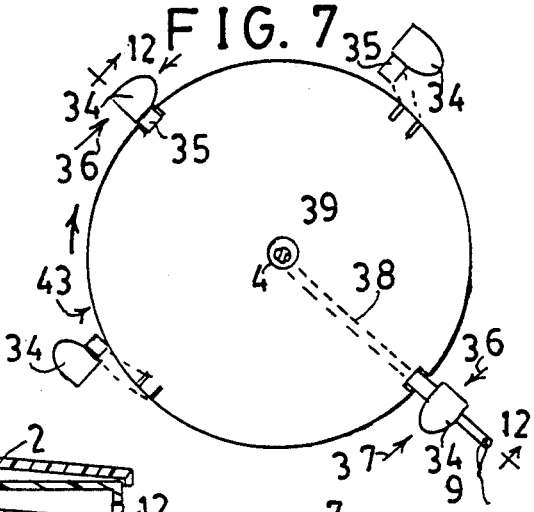
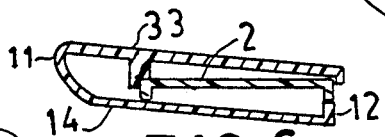
FIG. 6
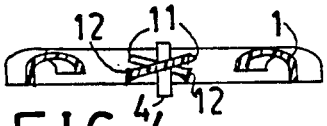
FIG. 4
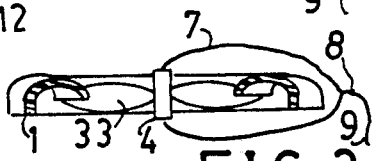
FIG. 3
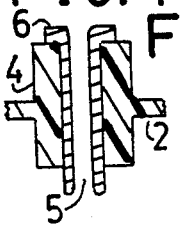
FIG. 5
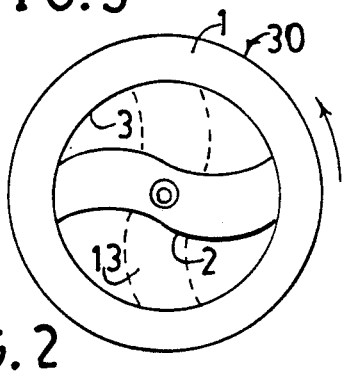
FIG. 2
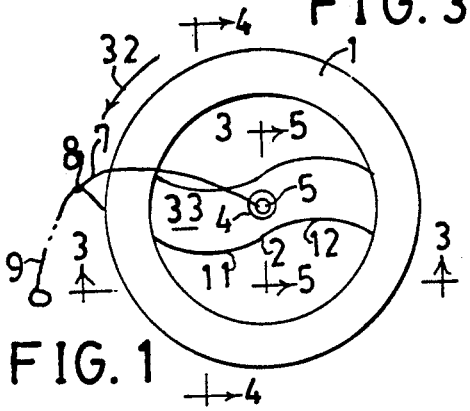
FIG. 1

TETHERED FLYING CIRCULAR SPINNING TOY

BACKGROUND OF THE INVENTION

This invention relates to a toy of the flying discus type and more particularly to a circular toy that spins and lifts when thrown and whose flight path is controlled by an attached monofilament tether.

U.S. Pat. No. 3,976,297 issued Aug. 24, 1976 to the applicant discloses a flying saucer-shaped disc that is thrown with a spinning motion by a flick of the user's wrist to provide the well known gyroscopic flying discus action. The disc is tethered by a monofilament line attached to a loop passing through an axial hole in the disc to cause the device to return to the thrower when tension is applied to the line.

Subsequent models have a circular rim with an open center. A flat bar across the diameter is connected to the rim at both ends and the axial hole is in the bar. No structures are provided in the prior art for maintaining the spinning or lift of the toy, so that the toy falls to the ground soon after launching. Young children do not have the strength and coordination to give the toy a sufficiently vigorous launch and spin to maintain flight long enough to be interesting.

SUMMARY OF THE INVENTION

It is accordingly an object of the invention to provide a tethered, spinning circular toy that provides lift while spinning to maintain flight. It is another object to provide such a toy with means to enhance the spinning action. It is yet another object of the invention to provide a launching device that sets the toy to spinning when the toy is pulled therefrom by the tether. It is yet another object of the invention to provide means for delivering a fishing hook or lure at a distance. It is yet another object of the invention to supply accessory elements for games to be played with the toy.

The toy of the invention comprises a circular rim member adapted to be readily grasped by one hand, at least one diametral element extends across the diameter of the rim member and connects at its ends to the rim member. The diametral element has an axial hole that is at the center of the rim element for a monofilament line that is tied in a loop. The loop connects to a monofilament line tether. The circular toy spins about the line through the center hole when thrown with a spinning motion. When tension is applied to the tether, the direction of motion of the flying disc is changed, so that the toy may be directed back and forth in continuous flight.

To maintain the elevation and spin of the toy, the diametral element is provided with a special shape to the leading and trailing edges thereof.

The special launcher holds the stationary toy at the correct attitude so that when it is pulled free by a tug on the tether it will fly at a correct angle. The launcher also causes the toy to spin as it is released.

These and other objects, advantages and features of the invention will become more apparent when the detailed description is considered in conjunction with the drawings.

BRIEF DESCRIPTION OF THE DRAWINGS

FIG. 1 is a top plan view of the flying toy of the invention.

FIG. 2 is a bottom plan view of the toy without the tether.

FIG. 3 is a sectional view taken through line 3—3 of FIG. 1.

FIG. 4 is a sectional view taken through line 4—4 of FIG. 1.

FIG. 5 is a sectional view taken through line 5—5 of FIG. 1.

FIG. 6 is a sectional view of another embodiment of the diametral element of the toy.

FIG. 7 is a top plan view of another embodiment of the invention.

FIG. 8 is a perspective view, partially broken away, of a launcher for the toy.

FIG. 9 is a diagrammatic view of a game assembly for the toy.

FIG. 10 is a diagrammatic view of a game assembly for the toy.

FIG. 11 is a diagrammatic view of a fishing assembly for the toy.

FIG. 12 is a sectional view, through line 12—12 of FIG. 7.

DETAILED DESCRIPTION OF PREFERRED EMBODIMENTS

Referring now first to FIGS. 1-5, the flying toy 30 of the invention comprises a circular rim or annulus 1 that is smoothly contoured to be comfortably caught by the hand while spinning rapidly, while also providing a good hand-hold for throwing with a spinning motion. A sigmoid cross bar 2 extends across the diameter of the rim, with both ends of the cross bar joined to the inner margin 3 of the rim. At the center of the circle, a tubulation 4 is connected to cross bar 2 with an axial hole 5 extending through the tubulation at the center of rotation. As best seen in FIG. 5, the tubulation 4 may include an insert 6 to provide a more precisely defined bearing surface for a monofilament line loop 7 that passes through the hole 5 and around the rim 1. The circular rim with cross bar spins about the loop. Being at the axis of rotation, there is very little relative surface motion where the loop 7 passes through the hole 5. Friction at this point must be kept to a minimum for prolonged spinning action. A swivel 8 connects the loop 7 to a tether line 9 which terminates in a wrist loop or band 10 to attach to one arm of the user. Alternatively, the wrist loop 10 may be replaced by a baton to be held by the user as described in applicant's earlier patent.

The cross bar or diametral member 2 is provided with special structure to enhance the spinning motion and provide lift as it spins to maintain altitude. This prolongs flight to give multiple trips to the extent of the tether from one throw and to provide ease of operation for younger children.

Looking from the top as in FIG. 1, the toy is for operation in counter clockwise rotation. The leading edges 11 of bar 2 are angled upward and are thin and streamlined, while the trailing edges 12 are angled downward and are relatively flat and vertical. When spinning in the preferred direction of rotation as shown by arrows 32, FIG. 1, the bar 2, with its sloping surfaces 33, acts as a propeller, forcing air downward and lifting the toy. When force is applied suddenly by a pull to the tether to change flight direction, or to launch the toy, air forces against the flat trailing edges 12 are greater than against the streamlined leading edges 11 which causes more spinning forces to be applied, much like an anemometer. The angles are exaggerated for illustrative purposes. As shown in phantom in FIG. 2, additional cross bars 13 of other shapes may be provided.

As shown in the embodiment illustrated in FIG. 6, at least a portion of the cross bar 2 may have an airfoil lifting shape provided by a snap-on portion 14 that may attach in either of two directions to provide lift in either clockwise or counterclockwise rotation as desired.

FIG. 8 shows a launcher 17, one end of which is pressed into the ground 18 at an angle of 15°. The launcher has an angled slot-like inner passage 19 with an opening 20 through which the toy 30 is inserted. The inner side walls 21 and 22 of the passage 19 are constructed to cause the toy to spin when it is pulled out of the passage by the tether 9. The shorter wall 21 is provided with a high friction surface while the longer wall 22 is provided with a smooth, low friction surface. Pulling on the tether forces the rim against the high friction surface which grips the rim, causing it to spin about its axis as it leaves the launcher through opening 20.

FIG. 9 illustrates a game with two players employing the toy. The tether 9 terminates in a sleeve 23 that slides on a horizontal line 24 supported by standards 25. Each player 26 must throw the toy 30 through the hoop 27 and the other player must catch it.

FIG. 10 shows a similar sleeve on line arrangement for a single player wherein the sliding sleeve 23 encounters a clamp 28 which limits the flight, pulling on the toy when the tether is fully extended to change the direction of flight and returning the toy 30 to the player 26 automatically.

FIG. 11 shows the use of two toys 30 used with a fishing rod 28 to cast fishing hooks 29 or fishing lures 31. The hooks are held sandwiched between the two rims before throwing for safety. The toys 30 are of a low overall density to float on the water.

Referring now to FIGS. 7 and 12, another embodiment of the invention is shown in which at least two wind cups 34 are snapped onto the rim 1 at diametrally opposed points on the outer margin of a discoidal flying toy 43 having the configuration of an inverted saucer with a continuous top wall 41 and an open bottom 42. The wind cups provide great resistance to the flow of air in a first direction as indicated by arrows 36 and low resistance to air flow in a second, opposite direction as indicated by arrows 37. When pulled by the tether line 9, the movement of the toy 30 through the air will cause the rim 1 to spin by action of these unidirectional air resistance elements 34. Connecting member 38 is pivotally connected to the toy 43 at its center of rotation. Connecting member 38 comprises a single connecting arm 40, so as to be clear of the cups 34, having a first end 44 arranged for connection of a tether line 9 and a second end arranged in the form of a snap-in axle 39 which passes through hole 2 in tubulation 4 connected to the wall 41. For enhanced performance, the cups should be located at a distance from the axis of at least half the radius of the disc.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A flying toy comprising:

A) an annulus having surfaces arranged for safe hand grasping while spinning, said annulus arranged in a plane and having an inner margin, an outer margin, and an axis of rotation about which it is made to spin by throwing with a spinning motion in a preferred direction of rotation;

B) at least one diametral element having a center portion connecting two intermediate portions, and two ends which are connected to said inner margin of said annulus, said center portion provided with a center hole disposed along said axis of rotation;

C) each intermediate portion having a leading edge and a trailing edge relative to said preferred direction of rotation, said leading edge arranged for reduced resistance to air forced against it and said trailing edge arranged for increased resistance to air forced against it, each said intermediate portion being provided with surfaces connecting said leading and trailing edges, said surfaces arranged at sloping angles to said plane of said annulus so as to provide an axial thrust when spinning, said axial thrust providing lift when spinning in said preferred direction of rotation;

D) a closed loop extending through said center hole and encircling a section of said annulus; and E) a tether line having two line ends, a first line end connected by connecting means to said closed loop and a second line end for connection to an inanimate or animate operator for control of the flight of said toy.

2. The flying toy according to claim 1, in which said center hole extends through an axial tubulation connected to said center portion of said diametral element.

3. The flying toy according to claim 2, in which said connecting means includes a swivel.

4. The toy according to claim 1, in which said intermediate portion includes removably attachable lift portions that may be attached in either of two reversible positions to said diametral element to provide lift in either one of clockwise and counterclockwise direction of rotation.

5. The flying toy according to claim 1, further comprising fish hook means connected to said closed loop.

6. The toy according to claim 1, further including a remote launcher for launching and spinning said toy by pulling on said tether line, said launcher comprising:

a) a housing having an opening for receiving said annulus, b) an elongate passage within said housing extending to said opening, said passage shaped to receive said annulus, having at least one bend, two long opposed sides, and two short opposed sides;

c) one of said short sides being provided with a high friction surface for frictionally engaging said outer margin of said annulus to thereby cause said toy to spin when pulled from said launcher.

7. The toy according to claim 1, in which said diametral element has a sigmoid shape.

8. A flying toy comprising:

A) an annulus arranged in a plane and having an inner margin, an outer margin, and an axis of rotation about which it is made to spin by throwing with a spinning motion in a preferred direction of rotation:

B) at least one diametral element having a center portion connecting two intermediate portions, and two ends which are connected to said inner margin of said annulus, said center portion provided with a center hole disposed along said axis of rotation;

C) each intermediate portion having a leading edge and a trailing edge relative to said preferred direction of rotation, each said intermediate portion being provided with airfoil surfaces connecting said leading and trailing edges, said surfaces arranged at sloping angles to said plane of said annulus so as to provide an axial thrust when spinning, said axial thrust providing lift when spinning in said preferred direction of rotation;

D) a connector means having a first connector end and a second connector end, said first connector end passing through said center hole for pivotal connection thereto;

E) said second connector end provided with tether attachment means for attachment of a tether line for control of the flight of said toy, said second connector end extending beyond the outer margin of said annulus.

9. The flying toy according to claim 8, in which said center hole extends through an axial tubulation connected to said center portion of said diametral element.

10. The toy according to claim 8, further including a remote launcher for launching and spinning said toy by pulling on said tether line, said launcher comprising:

a) a housing having an opening for receiving said annulus;

b) an elongate passage within said housing extending to said opening, said passage shaped to receive said annulus, having at least one bend, two long opposed sides, and two short opposed sides;

c) one of said short sides being provided with a high friction surface for frictionally engaging said outer margin of said annulus to thereby cause said toy to spin when pulled from said launcher.

11. The toy according to claim 8, further comprising: at least two unidirectional air resistance means attached in diametrally opposed paired locations on said annulus, whereby all said unidirectional air resistance means encourage spinning about said center hole in a common direction of rotation when said toy is pulled through the air by a tether line.

12. The toy according to claim 11, in which said unidirectional air resistance means are removably attachable.

13. A flying toy comprising:

A) a circular device arranged in a plane and having a central portion, a circumferential portion, and an axis of rotation;

B) a peripheral downwardly extending skirt continuous with said circumferential portion and having an outer margin;

C) an axially extending center hole passing through said central portion at said axis of rotation;

D) a connector means having a first connector end and a second connector end, said first connector end passing through said center hole for pivotal connection thereto;

E) said second connector end provided with tether attachment means for attachment of a tether line for control of the flight of said toy; and F) at least two unidirectional air resistance means connected to said device at a distance from said center hole that is greater than half the radius of said device, whereby all said unidirectional air resistance means urge spinning of said device in a common direction of rotation when said device is pulled through the air by a tether line.

14. A flying toy comprising:

A) a generally disc shaped device including, 1) a top wall 2) a peripheral downwardly extending skirt continuous with said top wall, thereby defining a generally inverted saucer configuration having a radius and 3) an axially extending center hole through said top wall;

B) a connector means having a first connector end and a second connector end, said first connector end passing through said center hole for pivotal connection thereto;

C) said second connector end provided with tether attachment means for attachment of a tether line for control of the flight of said toy; and D) at least two unidirectional air resistance means connected to said disc shaped device at a distance from said center hole that is greater than half the radius of said device, whereby all said unidirectional air resistance means urge spinning of said device in a common direction of rotation when said device is pulled through the air by a tether line.

15. A flying toy comprising:

A) an annulus arranged in a plane and having an inner margin, an outer margin, and an axis of rotation about which it is made to spin by throwing with a spinning motion in a preferred direction of rotation;

B) at least one diametral element having a center portion connecting two end portions which are connected to said inner margin of said annulus, said center portion provided with a center hole disposed along said axis of rotation;

C) a connector means having a first connector end and a second connector end, said first connector end passing through said center hole for pivotal connection thereto;

D) said second connector end provided with tether attachment means for attachment of a tether line for control of the flight of said toy, said second connector end extending beyond the outer margin of said annulus; and E) at least two unidirectional air resistance means attached to said annulus, whereby all said unidirectional air resistance means encourage spinning about said center hole in a common direction of rotation when said toy is pulled through the air by a tether line.

* * * * *